US010611435B2

(12) United States Patent
Trouve et al.

(10) Patent No.: US 10,611,435 B2
(45) Date of Patent: Apr. 7, 2020

(54) FAIRLEAD FOR GUIDING AN ANCHORING ELEMENT OF AN OFFSHORE STRUCTURE

(71) Applicant: NAVAL ENERGIES, Paris (FR)

(72) Inventors: Arnaud Trouve, Ruelle sur Touvre (FR); Jean-Luc Menet, Ruelle sur Touvre (FR)

(73) Assignee: NAVAL ENERGIES, Paris (FR)

( * ) Notice: Subject to any disclaimer, the term of this patent is extended or adjusted under 35 U.S.C. 154(b) by 0 days.

(21) Appl. No.: 16/092,515

(22) PCT Filed: Apr. 10, 2017

(86) PCT No.: PCT/EP2017/058502

§ 371 (c)(1),
(2) Date: Oct. 10, 2018

(87) PCT Pub. No.: WO2017/178406

PCT Pub. Date: Oct. 19, 2017

(65) Prior Publication Data

US 2019/0161144 A1 May 30, 2019

(30) Foreign Application Priority Data

Apr. 11, 2016 (FR) ..... 16 00607

(51) Int. Cl.
*B63B 21/10* (2006.01)
*B63B 21/18* (2006.01)
*B63B 21/50* (2006.01)

(52) U.S. Cl.
CPC ..... *B63B 21/10* (2013.01); *B63B 21/18* (2013.01); *B63B 21/50* (2013.01)

(58) Field of Classification Search
CPC ..... B63B 21/10; B63B 21/18; B63B 21/50; B66D 1/36; B66D 1/38
See application file for complete search history.

(56) References Cited

U.S. PATENT DOCUMENTS 3,638,599 A * 2/1972 Nilsen ..... B63B 21/18 114/200
4,423,697 A * 1/1984 Royset ..... F16G 15/00 114/199

(Continued)

FOREIGN PATENT DOCUMENTS

FR 2984272 6/2013
FR 3026085 3/2016

(Continued)

OTHER PUBLICATIONS

French Search Report for Application No. 1600607 dated Jan. 25, 2017.

(Continued)

*Primary Examiner* — Emmanuel M Marcelo
(74) *Attorney, Agent, or Firm* — Young & Thompson

(57) ABSTRACT

Disclosed is a fairlead for guiding an anchoring element of an offshore structure, such as a floating structure, at an anchoring point, of the type having a guide for the anchoring element and a lock holding the anchoring element in position, having a locking jaw including two locking jaw elements that are movable by a maneuvering unit actuated by a controller, between a closed position preventing the anchoring element from moving in translation and an open position releasing the anchoring element. The controller is of the impulse-type, and the maneuvering unit includes a pawl that defines successive stable open and closed positions of the jaw-forming unit.

11 Claims, 5 Drawing Sheets

(56) References Cited

U.S. PATENT DOCUMENTS

| | | | | |
|---|---|---|---|---|
| 4,862,821 | A * | 9/1989 | Ballantyne | B66D 1/72 114/293 |
| 5,364,075 | A * | 11/1994 | Montgomery | B63B 21/10 114/230.25 |
| 5,628,094 | A * | 5/1997 | Mizuno | A44B 19/305 24/423 |
| 5,845,893 | A * | 12/1998 | Groves | B63B 21/50 254/389 |
| 7,240,633 | B2 * | 7/2007 | Barlow | B63B 21/04 114/200 |
| 7,284,496 | B1 * | 10/2007 | Douceur | B63B 21/18 114/200 |
| 8,915,205 | B2 * | 12/2014 | Miller | B63B 21/10 114/200 |
| 9,371,113 | B2 * | 6/2016 | Eriksson | B63B 21/18 |
| 9,567,039 | B2 | 2/2017 | Busson | |
| 10,272,973 | B2 * | 4/2019 | O'Rourke | B66D 1/28 |
| 2005/0241558 | A1 | 11/2005 | Barlow | |
| 2009/0049658 | A1 * | 2/2009 | Takasawa | A44B 19/06 24/401 |
| 2009/0113676 | A1 * | 5/2009 | Chung | A44B 19/06 24/406 |
| 2010/0154176 | A1 * | 6/2010 | Walderhaug | B63B 21/18 24/116 R |
| 2011/0237142 | A1 * | 9/2011 | Hovik | B63B 21/08 441/3 |
| 2014/0286711 | A1 * | 9/2014 | Busson | B63B 21/50 405/224 |
| 2015/0361634 | A1 * | 12/2015 | Abrisketa Lozano | E02D 5/223 405/232 |
| 2017/0297657 | A1 | 10/2017 | Busson | |

FOREIGN PATENT DOCUMENTS

| | | |
|---|---|---|
| WO | 2010/085156 | 7/2010 |
| WO | 2011/126171 | 10/2011 |

OTHER PUBLICATIONS

International Search Report for Application No. PCT/EP2017/058502 dated Jun. 8, 2017.

* cited by examiner

FAIRLEAD FOR GUIDING AN ANCHORING ELEMENT OF AN OFFSHORE STRUCTURE

FIELD OF THE INVENTION

The present invention relates to a fairlead.

Specifically, the invention relates to a fairlead for guiding an anchoring element of an offshore structure, such as a floating structure, at an anchoring point.

Still more particularly, this invention may relate to a fairlead associated with an offshore structure, such as floating energy production supports or the like, construction platforms, drilling platforms, loading and unloading buoys, or even floating platforms for exploiting renewable marine energies such as offshore wind-based installations or energy production plants based on ocean thermal energy, etc.

Such floating structures must be kept in position, whereas they are subject to different forces, and in particular drift forces for example generated by marine currents, the swell, wind, etc.

BACKGROUND OF THE INVENTION

To keep these structures in position for example on an operating site, anchoring means are for example used implementing a set of anchoring lines made up in whole or in part of chains, in particular at their ends.

Such lines are then for example arranged regularly around the structure to be moored or anchored, and extend between said structure and respective mooring or anchoring points, for example on the seabed.

One can then see that the mooring and anchoring lines, the first ends of which in the form of chains are attached on said mooring and anchoring points, rise to the floating unit and are associated therewith, through the chain entry guiding means.

These guide means are also known in the technical field as fairleads.

These fairleads are in fact mechanical devices that include fastening and attachment means on the floating structure and guide means for a chain.

These fairleads are also associated in one way or another with means for placing said chains under tension and means for locking the chains in order to moor said structure.

The tensioning means may for example include winches or windlasses or the like.

The systems for locking the chains are also called chain stoppers in the state of the art.

Different embodiments of these various means are already known in the state of the art.

Thus for example, document FR A 2,984,272 describes a fairlead for such an application.

Indeed and in general, this fairlead includes means for guiding the anchoring element, which assumes the form of a chain, and means for locking said chain in position, including means in the form of a locking jaw comprising two locking jaw elements that are movable, by maneuvering means actuated by control means, between the inactive position locking the translation of the anchoring element and an open position releasing said anchoring element.

Indeed, these jaw-forming means include two locking jaw elements that are moved by the maneuvering means actuated by the control means, between a closed active position locking the translation of the chain and an open retracted position releasing said chain.

Of course, other example embodiments of said fairleads are known in the state of the art.

However, all of these fairleads, and in particular the control means of the locking jaw-forming means, have one common point.

Indeed, they require the maintenance of an action and a command on an actuator to keep the jaw-forming means in an open position releasing the chain.

One can see that this presents a certain number of drawbacks in terms of the operating reliability of the system and maintenance of the power supply for example of a hydraulic or pneumatic actuator, etc., to obtain this unlocking and the release of the anchoring element.

SUMMARY OF THE INVENTION

The invention therefore aims to resolve these problems.

To that end, the invention relates to a fairlead for guiding an anchoring element of an offshore structure, such as a floating structure, at an anchoring point, of the type having means for guiding the anchoring element and means for locking said anchoring element in position, having means in the form of a locking jaw comprising two locking jaw elements that are movable by maneuvering means actuated by control means, between a closed position preventing the anchoring element from moving in translation and an open position releasing the anchoring element, characterized in that the control means are impulse-type control means, and in that the maneuvering means comprise pawl means that define successive stable open and closed positions of the jaw-forming means.

According to other features of the fairlead according to the invention, considered alone or in combination:

- the control means comprise a traction cable for a control finger of the jaw-forming means, movable along a closed path defining, with the pawl means, the two stable positions of the jaw-forming means;
- the pawl means have a first pawl defining, for the finger, a stable open position of the jaw-forming means;
- the pawl means have a second non-return pawl, for guiding the finger in a free return path of the latter toward a stable closed position of the jaw-forming means;
- the finger includes ends suitable for moving in guide slots arranged in two opposite flanges of a control unit of the jaw-forming means;
- the control unit is attached on one side of the guide means of the fairlead;
- the finger is connected to the jaw-forming means by a control cable;
- the control cable is connected to maneuvering levers of the jaw elements of the jaw-forming means;
- the levers comprise notched webs coupled to synchronize their movements and those of the jaw elements of the jaw-forming means;
- the maneuvering means comprise counterweight-forming means, coupled to the jaw-forming means to urge them into the closed position.

BRIEF DESCRIPTION OF THE DRAWINGS

The invention will be better understood upon reading the following description, provided solely as an example, and done in reference to the appended drawings, in which.

DETAILED DESCRIPTION OF INVENTION

Figure 1:
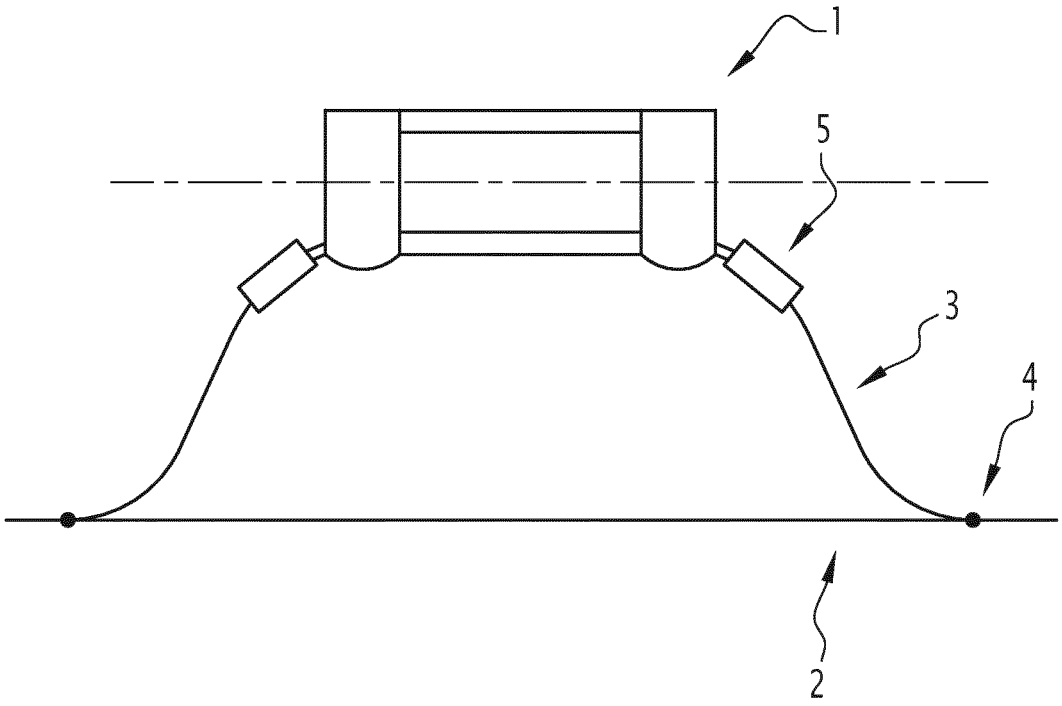
FIG. 1 shows a schematic side view of an offshore structure equipped with at least one fairlead according to the invention.

These figures, and in particular FIG. 1, show an offshore structure such as a floating structure, which is designated by general reference 1.

This structure 1 is moored on the seabed 2, via anchoring and mooring means.

Said anchoring and mooring means for example comprise anchoring lines, for example made up of chains.

One of said mooring and anchoring chains is for example designated by general reference 3.

One of the ends of said chain 3 is associated with an anchoring and mooring point on the seabed 2, and its other end is associated with the floating structure, for example through a guide fairlead, designated by general reference 5 in said FIG. 1.

Such anchoring and mooring lines and such fairleads are for example regularly distributed around the floating structure 1, and then make it possible to moor the latter on the seabed to keep it in position.

Figure 2:
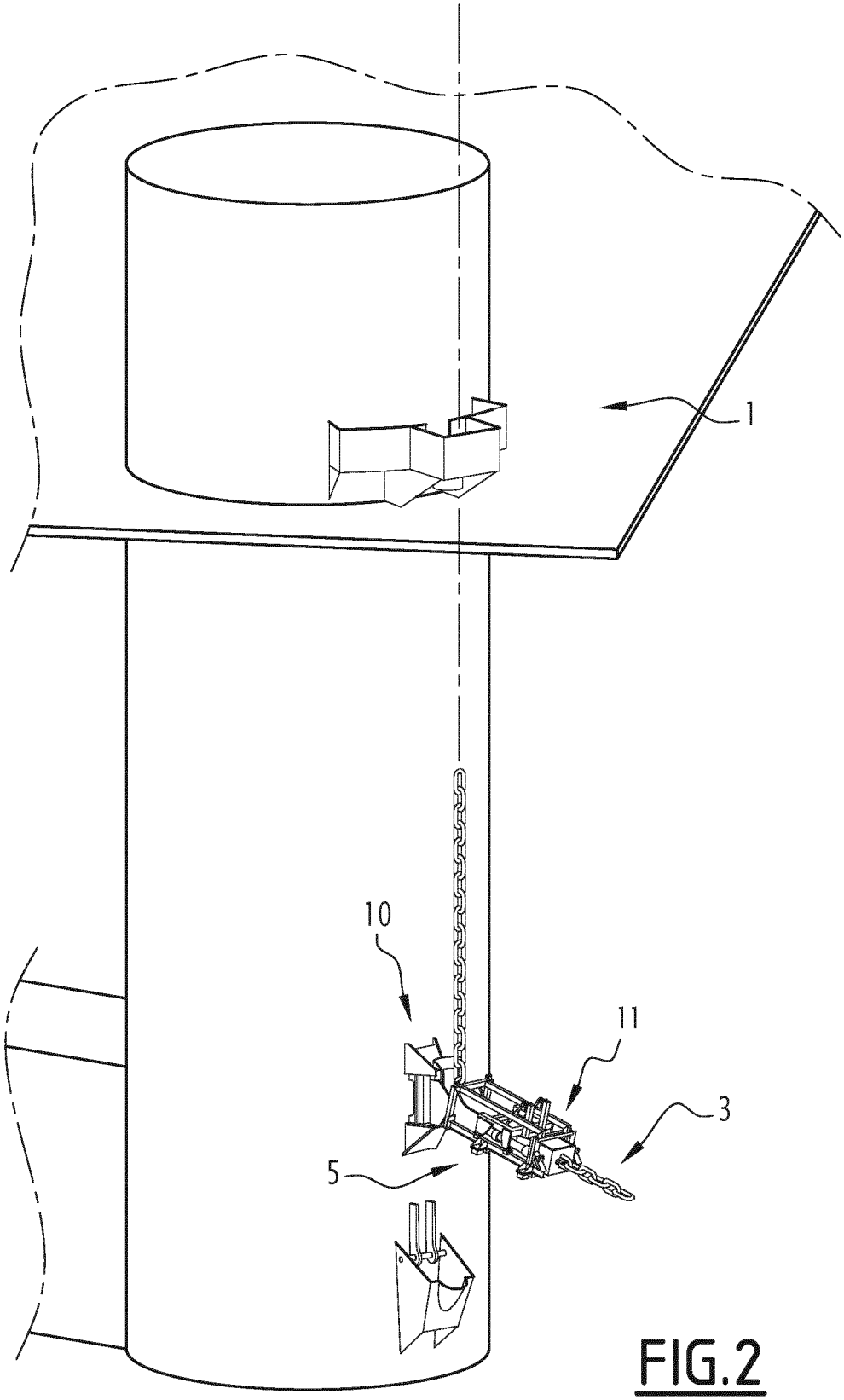
FIG. 2 shows a perspective view of part of such an offshore structure showing the installation of a fairlead according to the invention thereon.

In FIG. 2, the installation of such a fairlead is shown in more detail.

In this FIG. 2, the floating offshore structure is visible, designated by general reference 1, the anchoring and mooring line thereof, made up of the chain designated by general reference 3, and the fairlead designated by general reference 5.

This fairlead 5 then for example makes it possible to guide the anchoring element 3, to place it under tension and lock it in position, in order to keep the offshore structure in position, as previously described.

Figure 3:
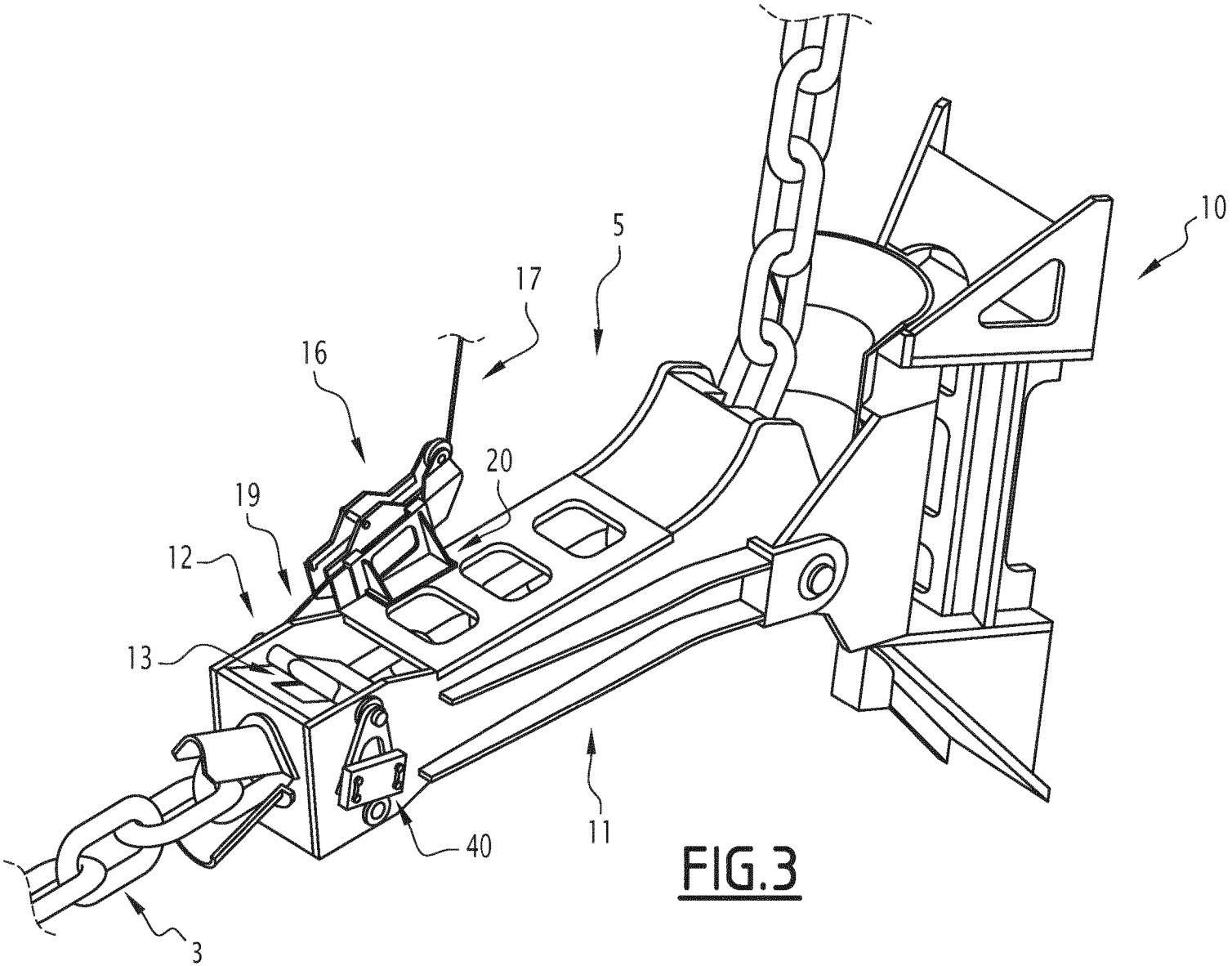
FIG. 3 shows a perspective view of one example embodiment of a fairlead according to the invention.

FIG. 3 shows one possible example embodiment of such a fairlead.

Said guide fairlead is still designated by general reference 5 in this FIG. 3.

Said guide fairlead 5 then includes fastening means on the floating structure, said fastening means being designated by general reference 10 in said FIG. 3.

Said fastening means 10 comprise any appropriate fastening platen, intended for example to be fastened by welding, bolting or the like, on the floating structure.

Guide means 11 for the anchoring structure 3 are for example mounted hingedly on said fastening platen 10.

Said guide means 11 then comprise means for guiding the translation of the anchoring element in the fairlead, making it possible to place said anchoring element under tension.

Additionally, said guiding means 11 also comprise locking means able to lock the translation of the anchoring element in the guide means, for mooring the offshore structure, for example floating, on the corresponding anchoring point.

Figure 4:
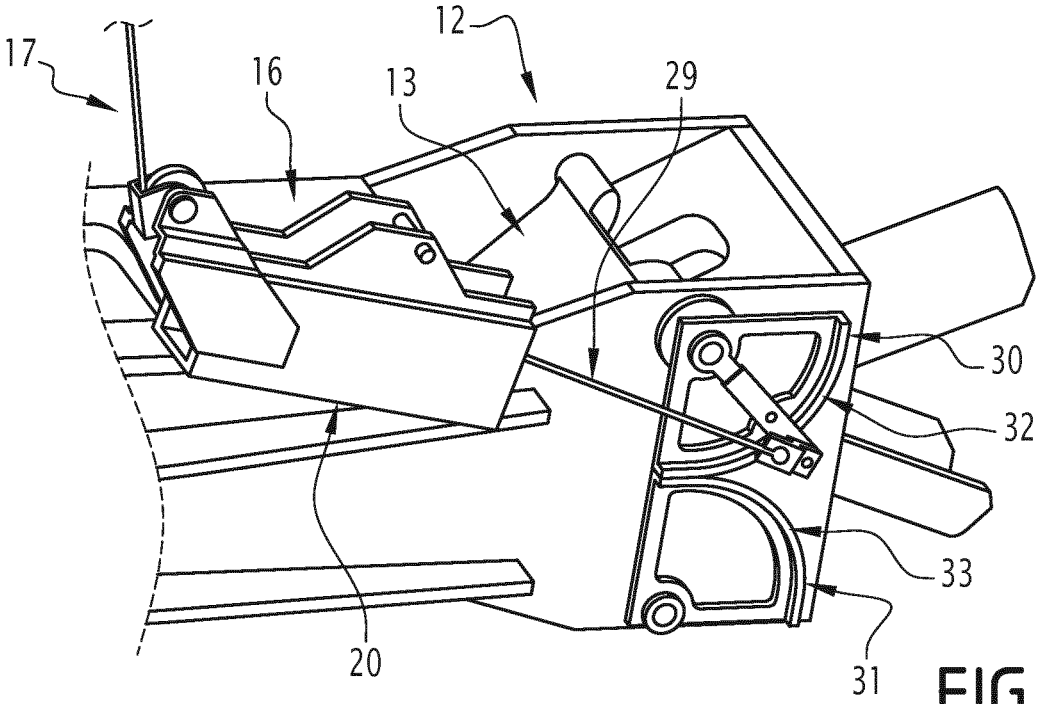
FIGS. 4 and 5 show perspective views of details of jaw-forming means in the composition of a fairlead according to the invention, and FIGS. 6 and 7 respectively show side and perspective views of a control unit in the composition of a fairlead according to the invention.
Figure 5:
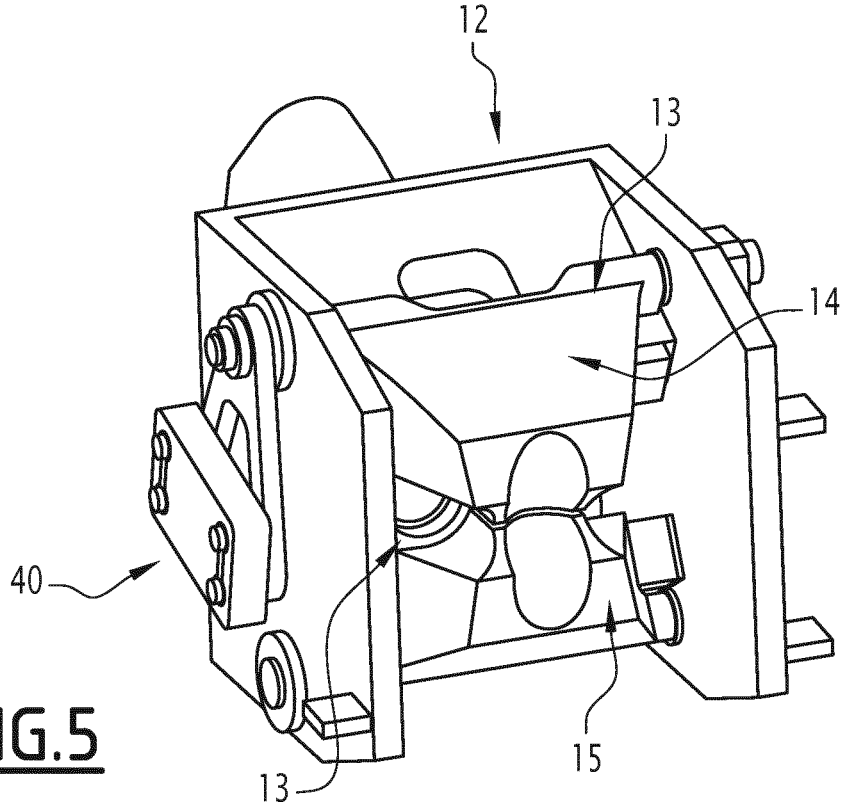

Indeed and as illustrated in FIGS. 3, 4 and 5, the locking means are designated by general reference 12 and comprise jaw-forming means for locking the anchoring element.

These jaw-forming means are designated by general reference 13 in these figures and for example comprise two locking jaw elements 14 and 15, respectively, which are articulated on the rest of the fairlead.

These locking jaw elements 14 and 15 are movable by maneuvering means, actuated by control means, between a closed position locking the translation of the anchoring element 3 and an open position releasing said anchoring element.

As previously indicated, in the state of the art, the control means of said locking means must maintain an action on the maneuvering means to keep them in the open position releasing the anchoring element.

If the action is not maintained, the jaw-forming means close under the effect for example of a resilient urging or a counterweight or the like, the lock the anchoring element.

In the fairlead according to the invention, the control means are impulse-type control means and the maneuvering means comprise pawl means defining successive stable open and closed positions of the jaw-forming means.

One can then see that depending on the operation of these means, the successive pulses of the control means make it possible to control a switching of the maneuvering means between the successive stable open and closed positions of the jaw-forming means.

To that end, pawl means are for example used that will be described in more detail.

One example embodiment of such pawl means, designated by general reference 16, is in fact given in these figures.

In particular in FIG. 3, one can see that said means 16 are connected via a traction cable 17 to the rest of the structure.

This traction cable 17 is indeed a cable that for example allows an operator to control the open or closed position of the jaw-forming means 13.

In the invention, said traction cable 17 is used to maneuver a control finger 18 of the jaw-forming means, said finger being associated with the pawl means designated by general reference 16.

Said pawl means 16 in turn comprise an output control cable, designated by general reference 19, for example connected to the control finger 18 and making it possible to control the jaw-forming means 13.

Figure 6:
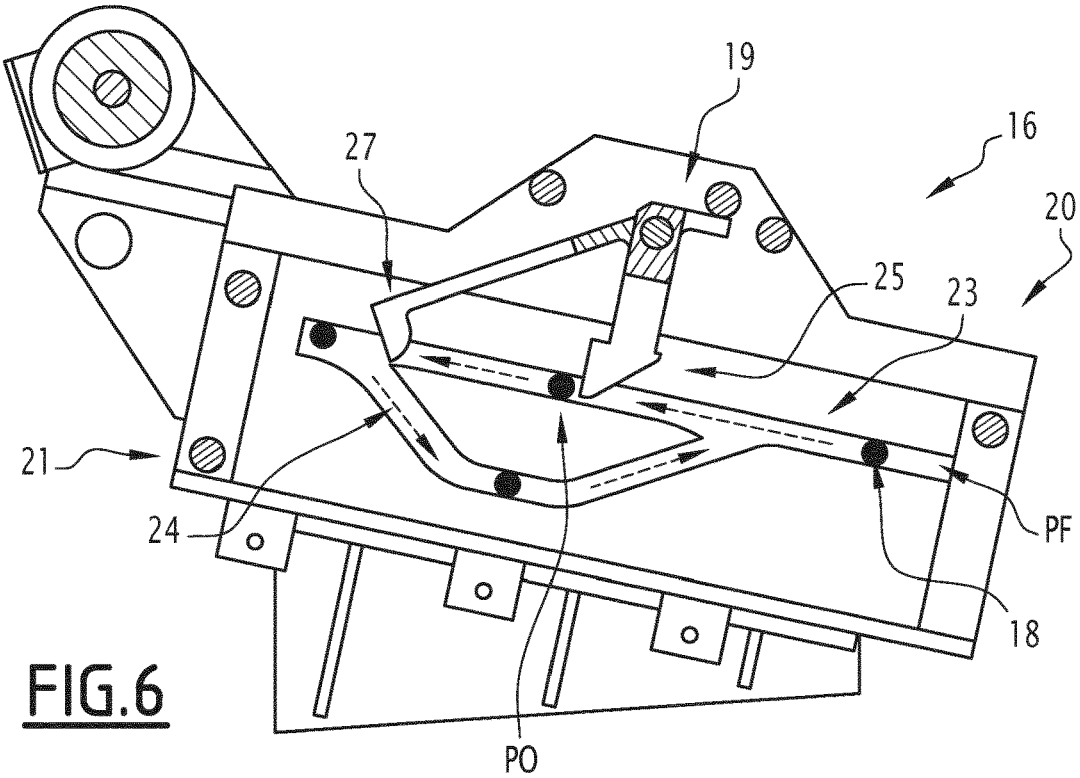
Figure 7:
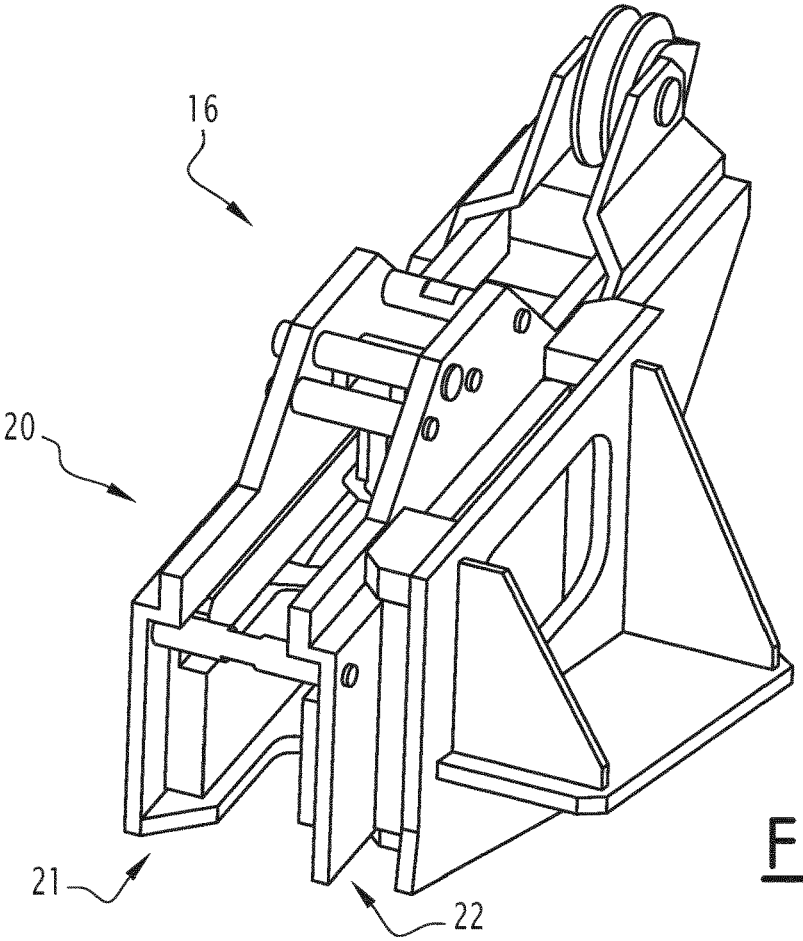

Indeed, the traction cable designated by general reference 17 makes it possible, as illustrated in FIGS. 6 and 7, to move the control finger 18 of the jaw-forming means 13 between stable open and closed positions thereof.

As illustrated in said FIGS. 6 and 7, the control means, and more particularly the pawl means designated by general reference 16, are in fact provided in a control unit, designated by general reference 20, fixed on one side of the fairlead.

Thus for example, said control unit 20 has a fitting, fastened for example by screwing or the like on the rest of the fairlead and more particularly on one side thereof, and still more specifically on one side of the guide means 11 of the fairlead.

Said control unit 20 then has two flanges, for example such as the flanges 21 and 22, across from one another and between which the control finger 18 of the jaw-forming means is arranged.

Said control finger 18 is then movable between the flanges 21 and 22 of the control unit 20, along a movement path 23 for example defined in the form of a path with a closed contour, by guide slots arranged in the opposite surfaces of said two flanges 21 and 22.

Said guide slots are then suitable for receiving and guiding the corresponding ends of said control finger 18.

FIG. 6 for example shows an example embodiment of one such slot, which is designated by general reference 24 and formed in the flange 21 of the unit 20.

The control finger 18 is then movable along a closed path that defines, with the pawl means 16, two stable positions of the jaw-forming means 13.

Indeed, and as illustrated in these figures, the pawl means include a first pawl designated for example by general reference 25, provided between the flanges 21 and 22 of the control unit.

This first pawl 25 is then mounted tilting in the control unit, which makes it possible, for example when the control finger 18 moves forward, between said flanges 21 and 22 of the unit, for said first pawl 25 to retract, to allow the control finger 18 to pass, before returning to the position locking the latter in a stable position corresponding to the stable open position of the jaw elements and therefore of the jaw-forming means to release the anchoring element.

Indeed, the control element 18 has controlled the opening of the jaw-forming means 13, and if the traction cable 17 is released, the control element 18 bears against said first pawl 25.

Said first pawl 25 keeps the control finger 18 in said open position of the jaw-forming means 13.

Upon a new impulse-type command of said means, i.e., upon a new action for example by an operator on the traction cable 17, the control finger 18 then goes from the open position PO of the jaw-forming means 13 to a closed position PF thereof, crossing a second pawl designated by general reference 27 in said FIG. 6.

Said second pawl 27 is in fact a non-return pawl, for guiding the control finger 18, in a free return path of the latter toward its stable closed position PF of the jaw-forming means.

As illustrated, the slots of the flanges, and for example the slot 24 of the flange 21, in fact include two path portions, namely a first path portion allowing the control finger 18, following a first traction impulse on the control cable 17, to go from its stable closed position PF of the jaw-forming means, to its stable open position PO of said jaw-forming means, by crossing the first pawl 25 and being kept in said stable open position by said first pawl.

Following a second traction impulse on the control cable 17, the control finger 18 then crosses the second pawl 27, and the action can then be released on said control cable to allow the finger 18, guided by the second non-return pawl, to follow the return path of said finger 18, toward its stable closed position of the jaw-forming means, therefore blocking the anchoring element of the structure.

This thus makes it possible to define two successive stable positions of the control finger by impulse-type control of the traction cable thereof.

Said control finger 18 is then connected, as previously indicated, by a control finger to the jaw-forming means 13.

Said control cable is for example illustrated in FIGS. 3 and 4 and is designated by reference 29.

Indeed and as illustrated, said control cable 29 is suitable for actuating maneuvering levers of the jaw elements 14 and 15 of the jaw-forming means 13.

In the example illustrated in FIG. 4, said maneuvering levers of the jaw elements are designated by general references 30 and 31.

Each of said levers 30 and 31 is then suitable for actuating one of the jaw elements of the jaw-forming means and/or pivoting them between their closed position and their open position.

In the described example, a single control cable 29 is used for example to move the lever 30.

Also in this example, the two levers 30 and 31 indeed comprise notched webs for example like the webs 32 and 33, as illustrated in said FIG. 4.

Indeed, said notched webs 32 and 33 are then coupled to one another and actuated owing to a single control cable 29, while having their movements synchronized.

Indeed, one can see that by maneuvering the control cable 29, the two jaw elements 14 and 15 of the jaw-forming means 13 are thus pivoted, synchronized with one another.

Of course, still other embodiments of these means can be considered.

Lastly, it will be noted that the maneuvering means of the jaw elements of the jaw-forming means also for example comprise counterweight-forming means, which are for example coupled to the jaw-forming means 13, to urge them into the closed position therefore locking the anchoring and mooring element of the structure.

In the example embodiment in particular illustrated in FIG. 5, said counterweight-forming means are designated by general reference 40.

Said counterweight-forming means 40 are for example associated with the jaw-forming means, for example at their articulation means on the rest of the fairlead, to urge them into the closed position.

One can then see that in the structure of the fairlead according to the invention, impulse-type control means are used for the opening and closing of the jaw-forming means.

Indeed, a traction impulse on the traction cable suffices to cause a movement of the maneuvering means between a stable closed position and a stable open position of the jaw-forming means.

This is done via pawl means interposed between the traction cable and the control cable of the jaw-forming means.

In the preceding, one possible example embodiment of such pawl means has been described.

Of course, many other embodiments can be considered.

Indeed, many embodiments of these pawl means can be considered, in order to allow them to define stable and sequential positions through an impulse-type control.

The invention claimed is:

1. A fairlead for guiding an anchoring element of an offshore structure, at an anchoring point, the guiding fairlead comprising means for guiding the anchoring element and means for locking said anchoring element in position, having means in the form of a locking jaw comprising two locking jaw elements that are movable by maneuvering means actuated by control means, between a closed position preventing the anchoring element from moving in translation and an open position releasing the anchoring element, wherein the control means are impulse-type control means, and wherein the maneuvering means comprise pawl means that define successive stable open and closed positions of the jaw-forming means, the impulse-type control means comprising a traction cable for a control finger of the jaw-forming means, the traction cable being movable by successive traction impulsions to control the switching of the maneuvering means between the successive stable open and closed positions of the jaw forming means.

2. The guiding fairlead according to claim 1, wherein the control finger of the jaw-forming means is movable along a closed path defining, with the pawl means, the two stable positions of the jaw-forming means.

3. The guiding fairlead according to claim 2, wherein the pawl means have a first pawl defining, for the finger, the stable open position of the jaw-forming means.

4. The guiding fairlead according to claim 3, wherein the pawl means have a second non-return pawl, for guiding the finger in a free return path of the finger toward the stable closed position of the jaw-forming means.

5. The guiding fairlead according to claim 4, wherein the finger includes ends suitable for moving in guide slots arranged in two opposite flanges of a control unit of the jaw-forming means.

6. The guiding fairlead according to claim 5, wherein the control unit is attached on one side of the guide means of the fairlead.

7. The guiding fairlead according to claim 2, wherein the finger is connected to the jaw-forming means by a control cable.

8. The guiding fairlead according to claim 7, wherein the control cable is connected to maneuvering levers of the jaw elements of the jaw-forming means.

9. The guiding fairlead according to claim 8, wherein the levers comprise notched webs coupled to synchronize their movements and those of the jaw elements of the jaw-forming means.

10. The guiding fairlead according to claim 1, wherein the maneuvering means comprise counterweight-forming means, coupled to the jaw-forming means to urge them into the closed position.

11. The guiding fairlead according to claim 1, wherein the offshore structure is a floating structure.

* * * * *